US006886961B2

(12) United States Patent
Hara et al.

(10) Patent No.: US 6,886,961 B2
(45) Date of Patent: May 3, 2005

(54) POWER TOOLS HAVING WIRE GUIDES FOR LIGHTS

(75) Inventors: Akihito Hara, Anjo (JP); Atsushi Utsuno, Anjo (JP)

(73) Assignee: Makita Corporation, Anjo (JP)

( * ) Notice: Subject to any disclaimer, the term of this patent is extended or adjusted under 35 U.S.C. 154(b) by 87 days.

(21) Appl. No.: 10/142,798

(22) Filed: May 13, 2002

(65) Prior Publication Data

US 2002/0172035 A1 Nov. 21, 2002

(30) Foreign Application Priority Data

May 15, 2001 (JP) ..... 2001-145026

(51) Int. Cl.[7] ..... H01R 33/00

(52) U.S. Cl. ..... 362/226; 362/109; 362/119; 362/120; 81/488

(58) Field of Search ..... 362/226, 109, 362/119, 120; 81/488

(56) References Cited

U.S. PATENT DOCUMENTS

| | | | | |
|---|---|---|---|---|
| 2,310,166 A | | 2/1943 | Way | |
| 2,525,588 A | | 10/1950 | Cameron et al. | |
| 2,852,051 A | | 9/1958 | Bickner | |
| 4,051,880 A | | 10/1977 | Hestily | |
| 4,108,225 A | | 8/1978 | Hestily | |
| 5,211,468 A | * | 5/1993 | Jeng | 362/120 |
| 6,022,121 A | * | 2/2000 | Lin | 362/119 |
| 6,033,082 A | * | 3/2000 | Lin | 362/120 |
| 6,086,217 A | * | 7/2000 | Jau | 362/119 |
| 6,179,433 B1 | * | 1/2001 | Shiao | 362/120 |

FOREIGN PATENT DOCUMENTS

| | | |
|---|---|---|
| DM | 1 410234 | 5/1937 |
| DM | 29 709437 | 10/1997 |
| FR | 667849 | 10/1929 |

* cited by examiner

*Primary Examiner*—Thomas M. Sember
*Assistant Examiner*—Jacob Y. Choi
(74) *Attorney, Agent, or Firm*—Dennison, Schultz, Dougherty & MacDonald

(57) ABSTRACT

Power tools (1) may include an electric motor (11) disposed within a housing (5). A lighting device (20) may be mounted on the housing and may serve to illuminate the area around a tool bit and/or a portion of a workpiece (W) that will be machined by the tool bit. An electric light (23) may be connected to a power source circuit **(11*a*) via an electric line that includes electric wires (25). In order to facilitate the wiring operation, a wire guide (22, 122) preferably supports or retains at least a portion of the electric line. The wire guide may be mounted on the housing such that the wire guide extends along an inner surface or an outer surface of the housing. In the alternative, the electric line may be disposed within a recess (31)** defined within an inner surface or an outer surface of the housing. In either case, the electrical line can be easily wired or installed and the electric line preferably does not interfere with machining operations during operation of the power tool.

17 Claims, 8 Drawing Sheets

POWER TOOLS HAVING WIRE GUIDES FOR LIGHTS

This application claims priority to Japanese application serial number 2001-145026, which application is hereby incorporated by reference herein in its entirety.

BACKGROUND OF THE INVENTION

1. Field of the Invention

The present invention relates to power tools, such as power routers and power screwdrivers. More specifically, the present invention relates to power tools that include one or more lights for illuminating an area around a tool bit and/or a portion of a workpiece that will be machined by the power tool, and one or more wire guides for retainably supporting an electric line connecting the light(s) to a power source.

2. Description of the Related Art

U.S. Pat. No. 4,051,880 teaches a power router that includes a light for illuminating the area proximal to a tool bit. More specifically, the light serves to illuminate the area around a chuck that holds the tool bit, i.e., the portion of a workpiece that will be machined by the router. The light is intended to improve visual recognition of the relative positions of the workpiece and the tool bit during the machining operation, so that working efficiency can be improved.

The power router includes a flat bottom that is disposed on the lower side of the router. The flat bottom is designed to support the router on the workpiece during the machining operation. A housing is secured onto the flat bottom and extends upward in the vertical direction. An electric motor is disposed within the housing. A chuck for holding a tool bit is disposed on the lower portion of the housing and is rotatably driven by the motor. The light also is disposed on the lower portion of the housing. A power source circuit for controlling the motor is disposed within the upper portion of the housing and is electrically connected to the light via an electric line.

In the power router of U.S. Pat. No. 4,051,880, the light and the electric line are supported in a manner that is substantially parallel to and separate from the housing. However, by disposing the electric line in this manner, the appearance of the router may be degraded and a possibility exists that the electric line will hinder the machining operation.

SUMMARY OF THE INVENTION

It is, accordingly, one object of the present teachings to provide improved lighted power tools. For example, in one aspect of the present teachings, lighted power tools may include one or more wire guides that facilitate the wiring of a lighting circuit to a power source and do not hinder machining operations.

According to another aspect of the present teachings, power tools are taught that may include an electric motor disposed within a housing. A lighting device may be mounted on or within the housing and may include a light for illuminating the area around a tool bit and/or a portion of a workpiece that will be machined by a tool bit. The light may be, e.g. an electric light, such as a light emitting diode (LED), a fluorescent lamp or an incandescent lamp. The electric light may be connected to a power source via an electric line that may include one or more electric wires. The power source receives an alternating current (AC) from a commercial electric source. In the alternative, the power source may be a DC power source, e.g., a battery that may be disposed within or removably attached to the housing of the power tool. In this case, the power source may be directly connected to the electric line. In order to facilitate the wiring operation, at least a portion of the electric line may be retained or supported by a wire guide that may be formed separately from the housing. The wire guide that holds the electric line may be mounted on the housing such that the wire guide extends along an inner surface or an outer surface of the housing. Therefore, the electrical line can be easily installed during the assembly of the power tool and the electric line preferably does, not interfere with the machining operation of a workpiece.

In another aspect of the present teachings, the light may be mounted on a light base that may be disposed within the housing. The light may be directly electrically connected to the electric line or may be connected to the electric line via a connector.

In another aspect of the present teachings, the housing may include a plurality of housing members that form the housing when assembled together. Optionally, the electric line may automatically connect to the power source or a power source circuit (i.e., a circuit that couples to, e.g., an AC power source) and/or the light at the same time that the housing members are assembled to form the housing. Therefore, the wiring operation can be easily and efficiently performed during assembly of the power tool.

In another aspect of the present teachings, the electric line may automatically connect to the power source or a power source circuit and the light at the same time that the wire guide is mounted on or within the housing. Optionally, the housing may include a wire receiving recess defined within the outer surface of the housing. In this case, the wire guide may be fitted into the wire receiving recess and the wire guide may cover the electric line, so that the electric line is enclosed between the housing and the wire guide. In this case, the wiring operation can be easily and efficiently performed by simply fitting the wire guide into the wire receiving recess.

Additional objects, features and advantages of the present invention will be readily understood after reading the following detailed description together with the accompanying drawings and the claims.

DETAILED DESCRIPTION OF THE INVENTION

Figure 1:
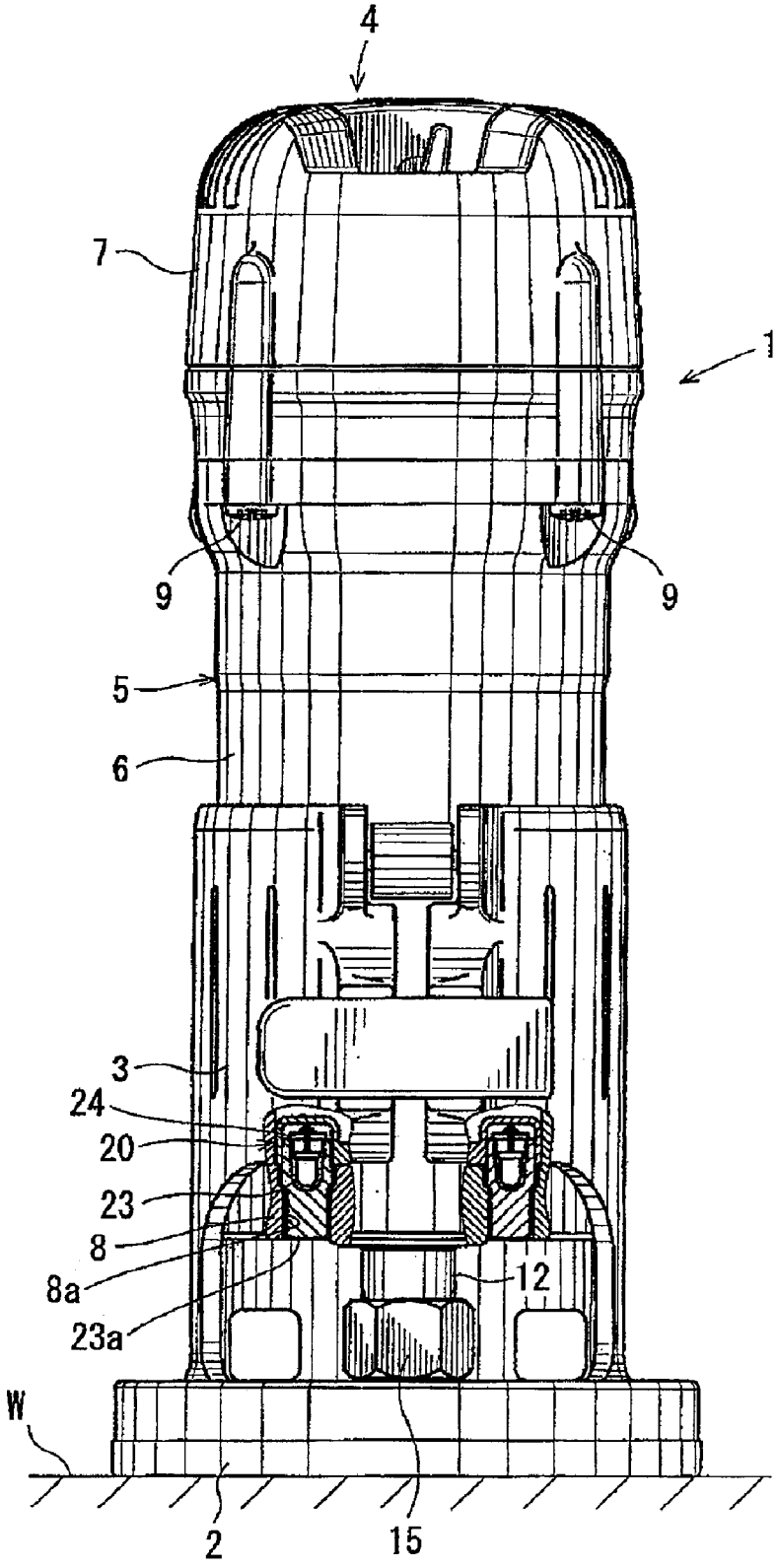
FIG. 1 is a front view of a representative power router.

In one embodiment of the present teachings, power tools may include a housing that has a housing wall. An electric motor may be disposed on or within the housing. A lighting device may be mounted on or within the housing and may include an electric light that is connected to a power source via an electric line. A wire guide preferably retains or supports at least a portion of the electric line. The wire guide may be mounted so as to extend along the housing wall. In this case, the wiring operation can be easily performed and the electric line may be reliably held or retained by the wire guide. The wire guide also may prevent the electric line from being exposed to the environment outside of the housing. Therefore, the electric line preferably does not interfere with machining operations.

In another embodiment of the present teachings, the lighting device may include a light base and the electric light. The wire guide may be mounted on or formed integrally with the light base and may be inserted into the housing so as to be mounted within the housing. In this case, the wire guide will extend along the inside of the housing wall. Therefore, the lighting device, including the electric line, may be efficiently installed when the power tool is assembled. In addition, if the electric line is disposed within the housing, the appearance of the power tool may be improved.

In another embodiment of the present teachings, a connector may connect the electric line to the power source. The connector may include a male connector element (e.g., plug) and a female connector element (e.g., a socket). One of the male and female connector elements may be connected to the electric line. The other of the male and female connector elements may be connected to the power source. The male connector element preferably connects to the female connector element during the assembly of the housing.

For example, the housing may include an upper housing member and a lower housing member, which together form the housing. According to this arrangement, the male connector element may be connected to the female connector element when the upper and lower housing elements are being attached to each other. Therefore, the lighting device may be easily mounted on or within the housing when the power tool is assembled.

In another aspect of the present teachings, a wire receiving recess may be defined within an outer surface of the housing and the wire receiving recess may be configured to receive the electric line. Preferably, the electric line may be first installed within the wire guide and then the electric line and the wire guide may be fitted into the wire receiving recess. In the alternative, the electric line may be directly received within the wire receiving recess and a separate cover may cover the electric line from the outside environment. Therefore, the electric line may be wired along the outer surface of the housing, so that the wiring operation can be easily performed. In this aspect as well, the electric line preferably does not interfere with machining operations.

Each of the additional features and teachings disclosed above and below may be utilized separately or in conjunction with other features and teachings to provide improved power tools and methods for designing and using such power tools. Representative examples of the present invention, which examples utilize many of these additional features and teachings both separately and in conjunction, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detail description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

Figure 2:
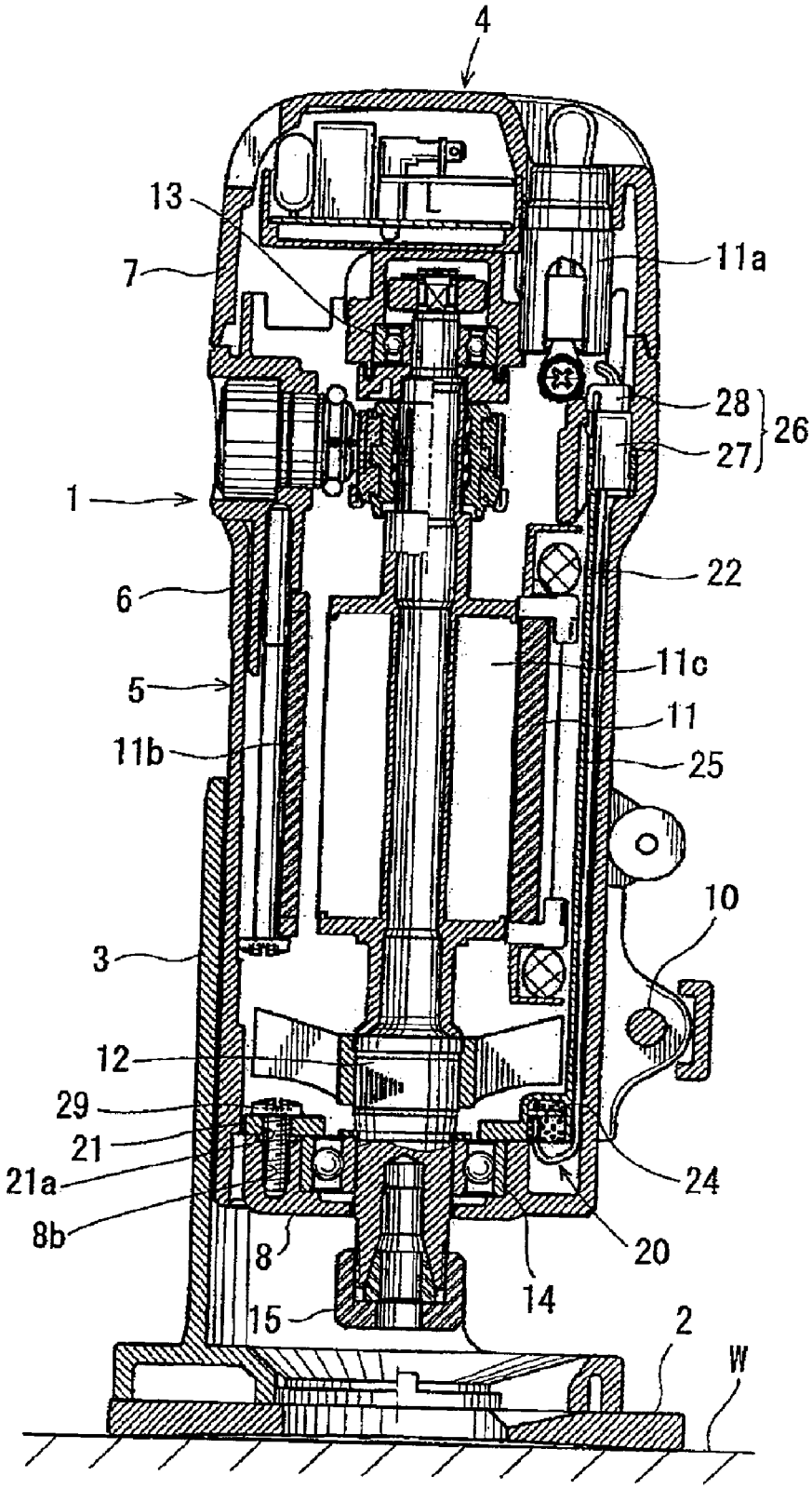
FIG. 2 is a vertical, cross-sectional view of the power router.

A first representative embodiment of the present teachings, which is a reciprocating power router, will now be described with reference to FIGS. 1 to 8. Referring to FIGS. 1 and 2, a representative power router 1 is respectively shown in a broken-away front view and a vertical, cross-sectional view. The power router 1 may include a router body 4 that is mounted on a flat bottom support 2. The longitudinal axis of the router body 4 preferably extends substantially in the vertical direction (i.e., substantially perpendicular to the surface of the flat bottom support 2). The router body 4 may include a tubular (cylindrical) housing 5 that comprises a lower housing member 6 and an upper housing member 7. One or more screws 9 may fixedly attach the lower housing member 6 to the upper housing member 7. Further, an open upper end of the lower housing member 6 preferably opposes and mates with an open lower end of the upper housing member 7.

The router body 4 may be mounted on the flat bottom support 2 such that the vertical position of the router body 4 can be adjusted with respect to the flat bottom support 2. For example, a support pedestal 3 may be mounted on the flat bottom support 2 in an upright position (i.e., substantially perpendicular to the flat bottom support 2). Preferably, the support pedestal 3 may have a substantially C-shaped horizontal cross section, so that the router body 4 can be inserted into the support pedestal 3 from the upper side. When inserted, the support pedestal 3 supports the outer side of the router body 4. As shown in FIG. 2, the router body 4 may be fixed in position relative to the support pedestal 3 using a tightening device 10, e.g., a bolt. When the tightening device 10 is loosened, the router body 4 can freely move in the vertical direction in order to adjust the cutting depth into the workpiece by a tool bit (not shown).

An electric motor 11, e.g. an AC motor, preferably serves as a drive device for the tool bit and may be substantially vertically disposed within the housing 5. That is, the longitudinal axis of the electric motor 11 is preferably substantially perpendicular to the surface of the flat bottom support 2. A motor shaft 12 may be rotatably supported by the lower housing member 6 and the upper housing member 7 via bearings 13 and 14. The motor shaft 12 may extend downward through a bottom plate 8 of the lower housing member 6. A chuck 15 may removably hold or retain the tool bit and may be mounted on the lower end of the motor shaft 12.

AC power may be supplied to the motor 11 from a commercial AC power source via an electric cord (not shown) and a power source circuit 11*a*. The power source circuit 11*a* may be, e.g., mounted within the upper housing member 7. The motor 11 may include a stator 11*b* and a rotor 11*c* and current may be supplied to the stator 11*b* and the rotor 11 via the power source circuit 11*a* in a known manner.

The representative power router 1 may slide along a workpiece W in order to machine the workpiece W using the tool bit. Preferably, the flat bottom support 2 slidably contacts the upper surface of the workpiece W during the machining operation in order to support the router 1 with respect to the workpiece W.

In order to enable an operator to visually recognize the portion of the workpiece W that will be machined using the tool bit in a reliable manner, the representative power router 1 may include a lighting device 20 that can illuminate the portion of the workpiece W that will be machined and/or the area (space) around the tool bit.

Referring to FIGS. 5 to 8, the representative lighting device 20 may generally include a light base 21 and a wire guide 22. For example, two or more light emitting diodes (LEDs) 23 and an LED circuit board 24 may be attached to the light base 21. The wire guide 22 may serve to hold or retain an electric line that includes electric wires (lead wires) 25. The electric wires 25 may extend from the LED circuit board 24 for coupling to the power source. Preferably, the light base 21 may be made of a hard synthetic resin that has electrical insulating properties. The light base 21 may have a substantially disk-shaped configuration with a central hole. The motor shaft 12 of the electric motor 11 may extend through the central hole.

Figure 5:
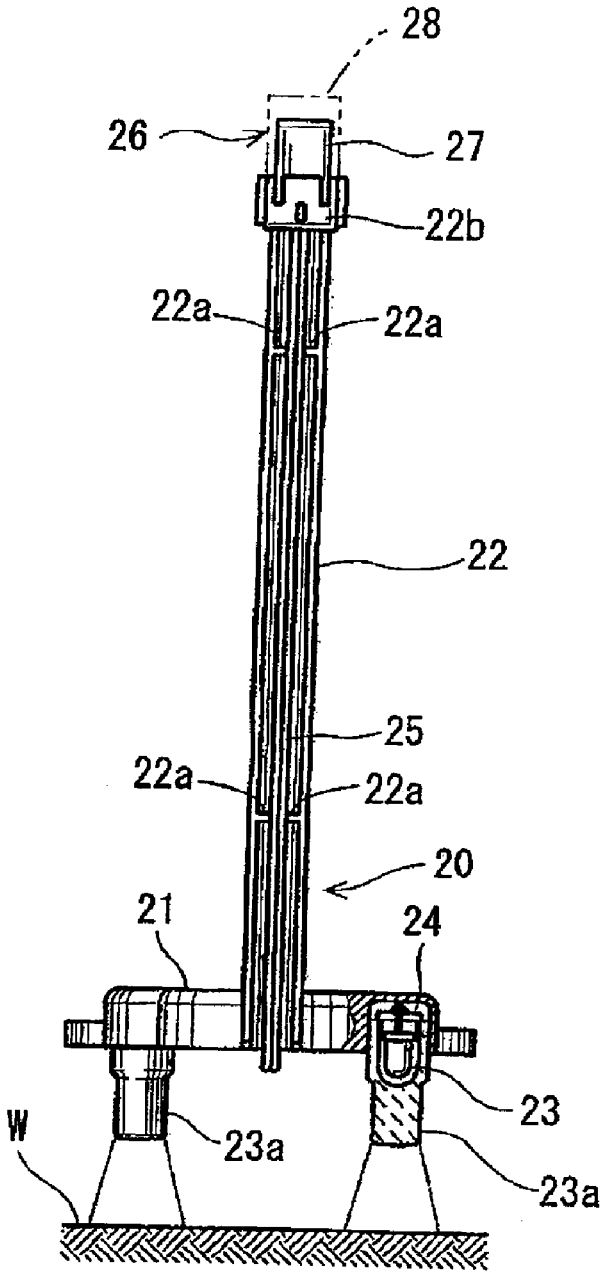
FIG. 5 is a front view of the first representative lighting device.
Figure 6:
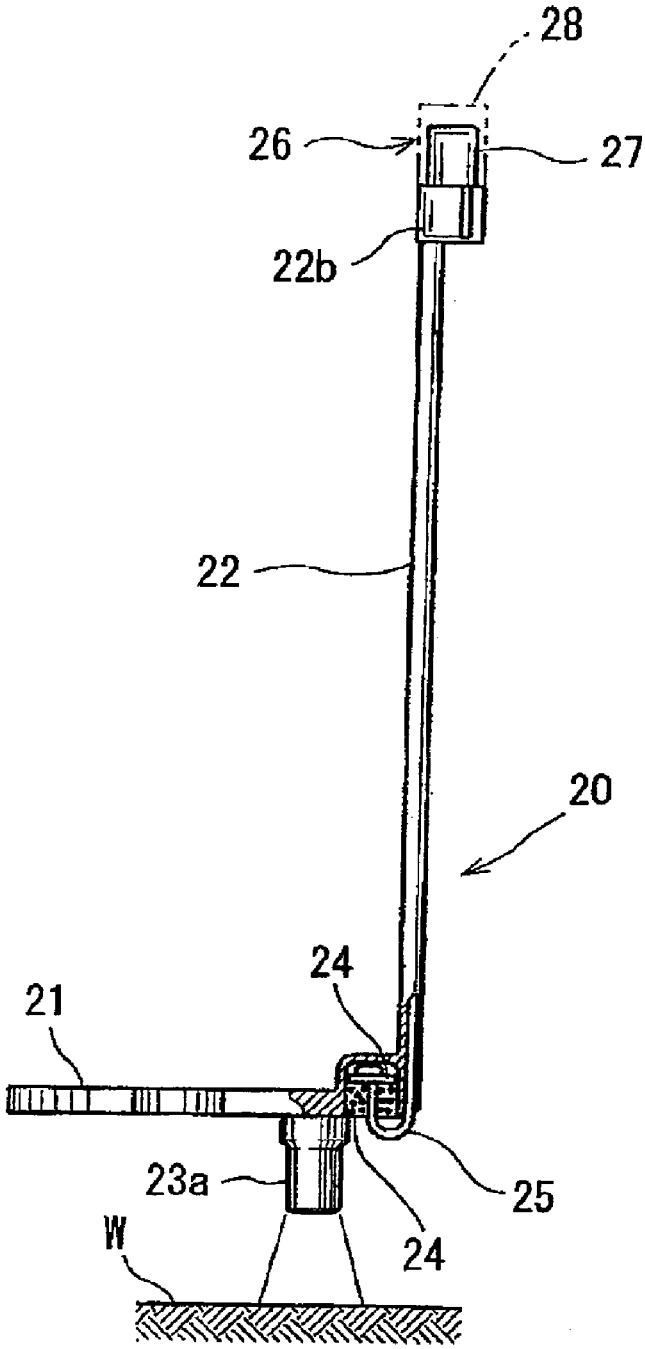
FIG. 6 is a side view of the first representative lighting device.

The LEDs 23 may be mounted on the light base 21 such that the LEDs 23 extend downward from the light base 21, as shown in FIG. 5. Preferably, a protective cover 23*a* may cover each of the LEDs 23 and the protective covers 23*a* may be, e.g., made of a transparent (or substantially transparent) synthetic resin or glass.

Figure 7:
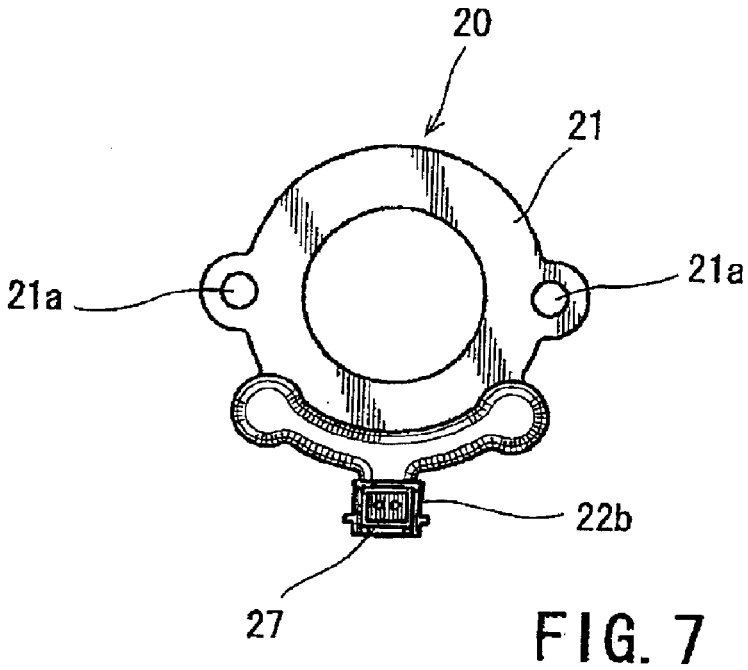
FIG. 7 is a plan view of the first representative lighting device.
Figure 8:
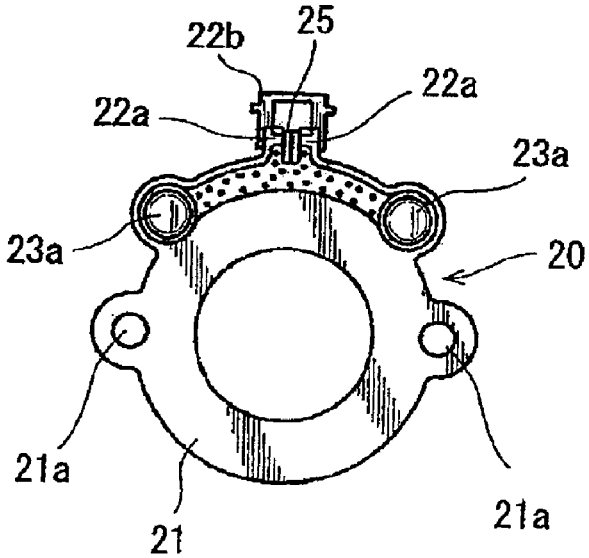
FIG. 8 is a bottom view of the first representative lighting device.

As shown in FIGS. 7 and 8, two or more through-holes 21*a* may be defined within the outer peripheral portion at positions suitably spaced from each other around the circumferential direction (periphery) of the light base 21.

The wire guide 22 may have a substantially U-shaped cross section so as to define a recess for receiving the electric wires 25. The wire guide 22 may extend upward from the outer peripheral portion of the light base 21 to a predetermined height. Optionally, the wire guide 22 may formed in one-piece (i.e., integrally formed) with the light base 21. The electric wires 25 may be received within the wire guide 22 and may extend along the wire guide 22. Clip portions 22*a* may clamp or retain the electric wires 25 against the wire guide 22 at a plurality positions that are spaced from each other along the longitudinal axis of the wire guide 22.

Figure 3:
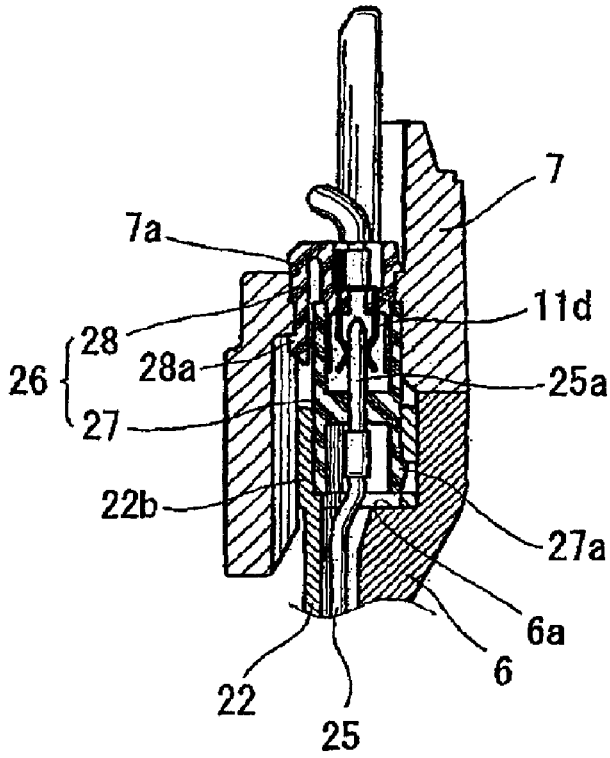
FIG. 3 is an enlarged cross-sectional view of a coupling, which includes a plug and a socket for connecting electric wires and a power source circuit.

Referring to FIGS. 2 and 3, the electric wires 25 may be electrically connected to the power source circuit 11*a* via a connector 26. The connector 26 may include a plug 27 and a socket 28 that respectively serve as a male connector element and a female connector element. The plug 27 may include one or more terminals 25*a* that are connected to the electric wires 25. The socket 28 may include one or more terminals 11*d* that are connected to the power source circuit 11*a*. The terminal(s) 25*a* preferably contact(s) or engage(s) the terminal(s) lid when the plug 27 has been fitted into the socket 28. The connector 26 may be mounted on the upper end of the wire guide 22. Further, the socket 28 may be mounted within the upper housing member 7.

For example, a box-shaped portion 22*b* may be defined on the upper end of the wire guide 22 and the plug 27 may be fitted into the box-shaped portion 22*b* from the upper side. A resiliently deformable detent claw 27*a* may be formed integrally with the plug 27 and may engage the box-shaped portion 22*b*. In this case, the plug 27 will be prevented from being removed from the lower housing member 6 when the plug 27 is completely fitted into the box-shaped portion 22*b*. A mounting hole 7*a* may be defined within the upper housing member 7 and the socket 28 may be fitted into the mounting hole 7*a* from the upper side. Also, a resiliently deformable detent claw 28*a* may be formed integrally with the socket 28 and may engage the peripheral portion of the mounting hole 7*a* in order to prevent the socket 28 from being removed after the socket 28 has been completely fitted into the mounting hole 7*a*.

Thus, the lighting device 20 of this representative embodiment may be configured as an assembly that includes the LEDs 23 and the electric wires 25, as well as the light base 21 and the wire guide 22 that support the LEDs 23 and the electric wires 25.

The lighting device 20 assembled as described above may be mounted within the lower housing member 6 prior to installation of the electric motor 11. Thus, with the light base 21 positioned downward, the assembled lighting device 20 may be inserted into the lower housing member 6 and may be placed on the bottom plate 8 of the lower housing member 6 as shown in FIG. 4.

Figure 4:
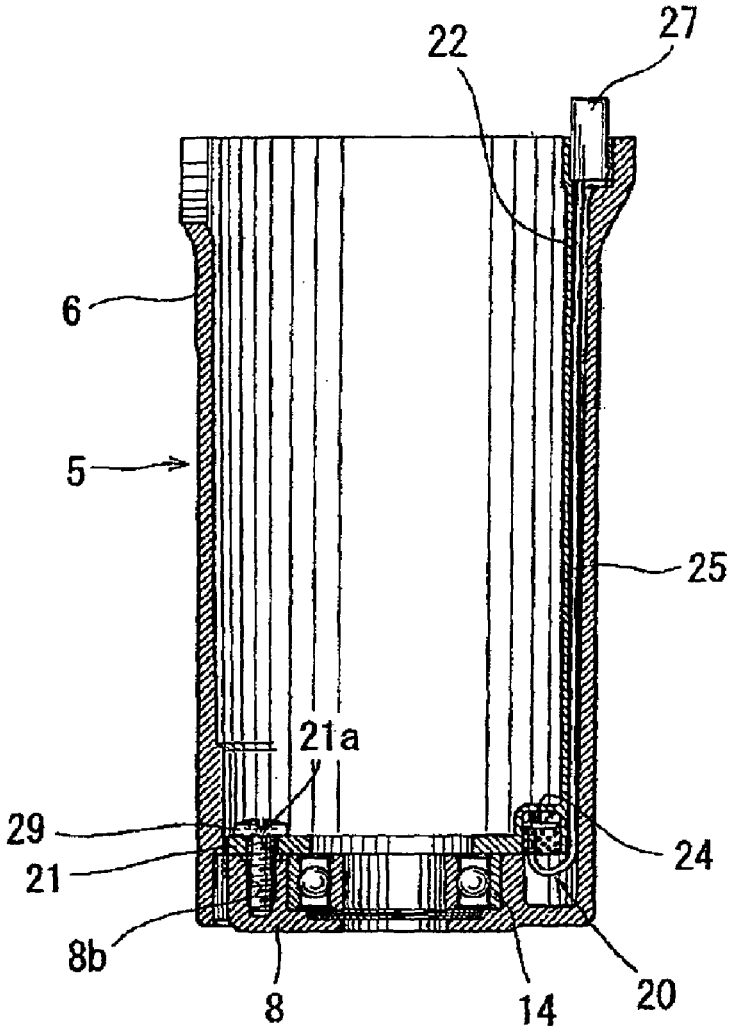
FIG. 4 is a vertical, cross-sectional view of a first representative lighting device mounted within a lower housing member.

As shown in FIGS. 1, 2 and 4, a plurality of through-holes 8*a* and a plurality of threaded holes 8*b* may be defined within the bottom plate 8. The through-holes 8*a* may be sized in order to receive the corresponding LEDs 23. The threaded holes 8*a* may be positioned in order to correspond to the through-holes 21*a* of the light base 21. Therefore, the light base 21 may be positioned such that the LEDs 23 are inserted into the through-hole 8*a*. Further, the through-holes 21*a* preferably align with the corresponding threaded holes 8*a*. Then, screws 29 may be inserted into the through-holes 21*a* and engage the corresponding threaded holes 8*a*. Thereafter, the light base 21 may be secured to the bottom plate 8 by tightening the screws 29.

When mounted, the open lateral side of wire guide 22 may contact the inner wall of the lower housing member 6 or may oppose the inner wall with a relatively small gap or clearance provided between the wire guide 22 and the inner wall. As a result, the electric wires 25 may be received within the wire guide 22 so that the electric wires 25 are reliably prevented from being removed from the wire guide 22. For example, as shown in FIG. 3, a shoulder portion 6*a* may be defined on a portion of the inner periphery of the open upper end of the lower housing member 6. When the lighting device 20 is mounted, the lower end of the box-shaped portion 22*b* may contact the upper surface of the shoulder portion 6*a*. In that case, the plug 27 may be held in a stable manner in an upright position.

After the lighting device 20 has been mounted within the lower housing member 6 as described above, the electric motor 11 may be mounted within the lower housing member 6. Preferably, prior to installing the electric motor 11 within the lower housing member 6, the upper side portion of the electric motor 11 and the associated power source circuit 11*a* may be installed within the upper housing member 7. The lower portion of the pre-assembled electric motor 11 may then be inserted into the lower housing member 6 and the lower end of the motor shaft 12 may be inserted into the inner race of the bearing 14. Subsequently, the upper housing member 7 may be placed over the lower housing member 6 so that the open end of the lower housing member 6 will engage the open end of the upper housing member 7. Thereafter, the lower housing member 6 may be joined to the upper housing member 7 by one or more screws 9, as shown in FIG. 1.

When the open end of the lower housing member 6 begins to engage the open end of the upper housing member 7, the plug 27 may be inserted into the socket 28 that is secured to the upper housing member 7. In addition, the terminals 25*a* of the wires 25 may engage the terminals 11*d* of the power source circuit 11*a*. As a result, the power source circuit 11*a* may be electrically connected to the LEDs 23.

In this representative embodiment, the claw 28*a* prevents the socket 28 from being removed from the upper housing member 7. In addition, the box-shaped portion 22*b* of the wire guide 22, which receives the plug 27, contacts the shoulder 6*a* of the lower housing member 6 and also substantially contacts the inner wall of the lower housing member 6. Therefore, the plug 27 may be positioned in a stable manner and the plug 27 can be easily and reliably connected to the socket 28. Consequently, the wire guide 22 may be positioned in a stable manner along the inner wall of the lower housing member 6 and preferably does not interfere with the rotor 11*c* of the motor 11.

According to the above representative lighting device 20, light may shine through the through-hole(s) 8*a* defined within the bottom plate 8 of the lower housing member 6. Therefore, the operator can visually recognize the relative positions of the workpiece W and the tool bit in a reliable manner.

In addition, because the pre-assembled lighting device 20 may be first inserted into the lower housing member 6 and then assembled therein, the lighting device 20 can be assembled within the housing 5 as an element of the power router 1 in the same manner as the other functional elements of the power router 1. Thus, the lighting device 20 (including the electric wires 25) can be easily installed by inserting the lighting device 20 into the lower housing member 6. The screws 29 may then fix the lighting device 20 in position relative to the bottom plate 8, as shown in FIGS. 2 and 4.

In the above representative embodiment, the electric wires 25, which connect the LEDs 23 to the power source circuit 11*a*, are disposed so as to pass through or extend along the tubular lower housing member 5. Moreover, the electric wires 25 can be efficiently wired through the lower housing member 5 so that the electric wires 25 do not interfere with the other parts within the lower housing 5. In addition, the electric wires 25 can be easily connected to the power source circuit 11*a* by utilizing the connector 26.

Further, because the electric wires 25 are not exposed to the outside environment, the appearance of the power router 1 may be improved and the electric wires 25 preferably will not interfere machining operations using the power router 1.

A second representative wiring arrangement of the lighting device 20 will now be described with reference to FIGS. 9 and 10. In this embodiment, similar elements will be given the same reference numerals as in the first representative embodiment and modified or new elements will be assigned new reference numerals. Thus, in this embodiment, a light base 121 may be formed separately from a wire guide 122 and the light base 121 may be joined to the wire guide 122 when being installed within the lower housing member 6. In addition, the electric wires 25 may be wired so as to extend along the outer wall of the lower housing member 6.

Figure 10:
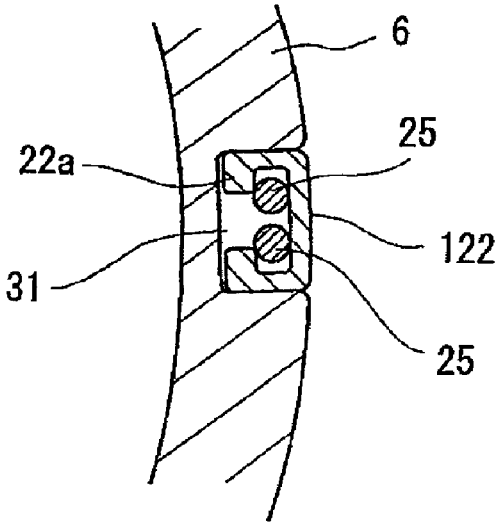
FIG. 10 is a cross-sectional view taken along line X—X shown in FIG. 9.

As shown in FIG. 10, a wire receiving recess 31 may be defined within the outer wall of the lower housing member 6 and may extend along the vertical direction of the power tool (i.e., parallel or substantially parallel to the axial direction of the lower housing member 6). The wire guide 122 may have a substantially C-shaped cross section as shown in FIG. 10. The wire guide 122 (with the electric wires 25 inserted therein) may be received within the wire receiving recess 31 such that the outer surface of the wire guide 122 extends substantially flush with the outer wall of the lower housing member 6. In the same manner as the first representative embodiment, the electric wires 25 may be held in position relative to the wire guide 122 by the clip portions 22*a*. As a result, the electric wires 25 may be wired (extend) along the outer wall of the lower housing member 6. Furthermore, the electric wires 25 may be covered by the wire guide 122 to prevent exposure to the outside environment.

Figure 9:
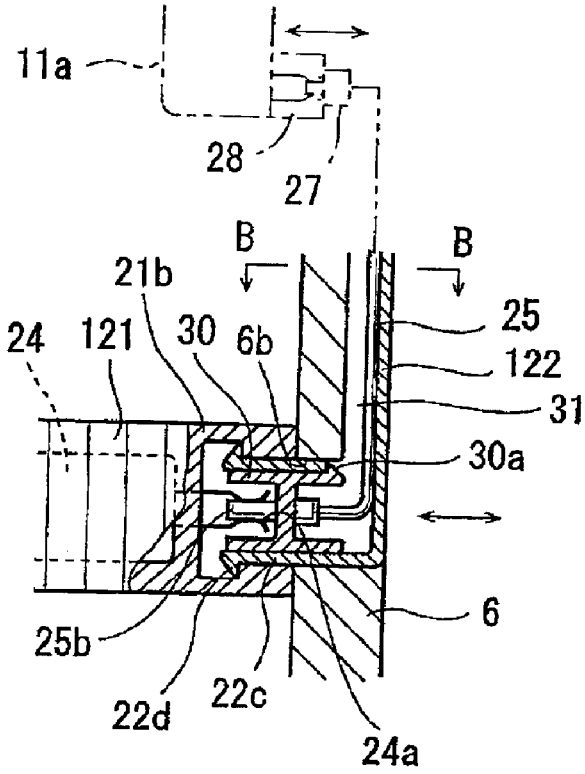
FIG. 9 is a vertical, cross-sectional view of a portion of a second representative lighting device.

In addition, the wire guide 122 may include a lower end having a joint portion, for example, a box-shaped portion 22*c* with lateral openings as shown in FIG. 9. A plug 30 may be fitted into the box-shaped portion 22*c* and may have resiliently deformable claws 30*a* that may serve to prevent the plug 30 from being removed from the box-shaped portion 22*c*. The box-shaped portion 22*c* (together with the plug 30) may be inserted from the outside through a through-hole 6*b* defined within the lateral wall of the lower housing member 6 and may be fitted into a lateral socket portion 21*b* formed on the light base 121. Also, the box-shaped portion 22*c* may have resiliently deformable claws 22*d* that may serve to prevent the box-shaped portion 22*c* from being removed from the socket portion 21*b*.

The plug 30 may include terminals 25*c* that are connected to the electric wires 25 and the socket portion 21*b* may include terminals 24*a* that are connected to the LED circuit board 24. The terminal(s) 25*b* preferably may be connected to the terminal(s) 24*a* at the same time that the box-shaped portion 22*c* is fitted into the socket portion 21*b*.

Further, in this representative embodiment, the electric wires 25 may be connected to the power source circuit 11*a* by the plug 27 and the socket 28 as schematically shown in FIG. 9. However, in this representative embodiment, the plug 27 may be fitted into the socket 28 in the lateral direction., i.e. in the same fitting direction as the box-shaped portion 22*c*. In addition, the box-shaped portion 22*b* that retains the plug 27 may be inserted laterally from the outside through a through-hole (not shown) that may be defined within the lateral wall of the upper housing member 7. The box-shaped portion 22*b* may then be fixed in position relative to the upper housing member 7, e.g. by fitting engagement with the through-hole.

According to the second representative embodiment, the electric wires 25 can be wired from the outside of the lower housing member 6 and the upper housing member 7 after the light base 121 of the lighting device 20, the electric motor 11 and the other associated parts have been installed within the housing 5. Thus, the electric wires 25 may be disposed within the wire guide 22 so as to electrically connect the upper plug 27 to the lower plug 30. The wire guide 22 may then be fitted into the wire receiving recess 31 of the lower housing member 6. Thereafter or at the same time, the upper and lower box-shaped portions 22*b* and 22*c* may be respectively inserted into the lower housing member 6 and the upper housing member 7, so as to be fixed in position and to electrically connect the electric wires 25 to the LED circuit board 24 and the power source circuit 11*a*, respectively. Therefore, the electric wires 25 may be easily installed (wired).

Although the electric wires 25 are wired (extend) along the outside of the housing 5, the wire guide 22 with the electric wires 25 are received within the wire receiving recess 31. Therefore, the electric wires 25 preferably do not interfere with machining operations performed by the power tool. Although the wire guide 25 is fixed in position relative to the housing 5 by fitting the upper and lower box-shaped portions 22*b* and 22*c* into the housing 5 in this representative embodiment, the wire guide 25 may be fixed in position relative to the housing 5 by a variety of other fixing or attaching devices.

The present teachings are not limited to the representative embodiments described above and may be modified in various ways. For example, although the wire guide 22 and the light base 21 are formed integrally with the light base 21 in the first representative embodiment shown in FIGS. 1 to 8, these parts may be formed separately from each other and may be connected to each other by means of the box-shaped portion 22*c* and the socket 21*b*, as was described in the second representative embodiment shown in FIGS. 9 and 10. In such case, the LED circuit board 24 may be connected to the electric wires 25 by an appropriate connector.

In the second representative embodiment, the wire guide 122 may be omitted and may be replaced with a cover that is fitted into the wire receiving recess 31 in order to cover the electric wires 25.

Furthermore, the LEDs 23 may be replaced with other types of illumination devices (light emitting devices), such as fluorescent lamps and/or incandescent lamps. Moreover, the positions of the plug 27 and the socket 28 may be interchanged such that the plug 27 is connected to the power source circuit 11*a* and the socket 28 is connected to the electric wires 25.

In addition, the configuration of the housing 5 may be modified in various ways. For example, the housing 5 may comprise a pair of housing halves that are separated from each other with respect a plane that extends through the central vertical axis of the housing 5.

Although power is supplied from an outside power source to the lighting device 20 via the power source circuit 11*a* in the above representative embodiments, power tools according to the present teachings may include an internal or external battery that is connected to the lighting device 20 via the electric wires 25. In each case, the wire guide 22 may serve as a guide for the electric wires 25 that comprise a portion of an electrical line wired through or along the housing 5.

Further, although the wire recess 31 was defined within the outer surface of the housing 5 in the second representative embodiment, the wire recess 31 also may be defined within an inner surface of the housing 5.

Finally, although the representative embodiments were directed to a power router, naturally the present teachings are applicable to a wide variety of power tools, including, e.g., power screwdrivers.

What is claimed is:

1. A power tool comprising:

a housing having a housing wall, an electric motor disposed within the housing, a power source circuit disposed within the housing, the power source circuit being arranged and constructed to connect to a source of current, a light connected to the power source circuit via an electric line, the light being mounted on or within the housing in a manner that will illuminate a tool bit and/or an area of a workpiece that will be machined by the power tool, a wire guide retaining at least a portion of the electric line, the wire guide extending along and proximal to an inner surface or an outer surface of the housing wall wherein the housing comprises at least a first housing portion and a second housing portion, the power tool further comprising a connector that connects the electric line to the power source circuit, the connector having a male connector element and a female connector element, one of which is connected to the electric line and the other of which is connected to the power source circuit, wherein the male connector element and the female connector element are arranged and constructed to be connected to each other when the first housing portion is being coupled to the second housing portion.

2. A power tool as in claim 1, further comprising a light base coupled to the light and the wire guide.

3. An apparatus comprising:

a housing, a motor disposed within the housing, a light mounted on or within the housing in a manner so as to illuminate at least a portion of a workpiece being machined by a tool attached to the apparatus or an area proximal to the tool, a power source circuit disposed on or within the housing, an electric line connecting the light to the power source circuit, means for retaining at least a portion of the electric line along and proximal to an inner surface or an outer surface of the housing wherein the retaining means further comprises a connector that is arranged and constructed to detachably and electrically connect the electric line to the power source circuit, wherein the connector comprises a pair of connector elements that are electrically and mechanically connected to each other, one of the connector elements being connected to the electric line and being fixed in position relative to the retaining means, and the other of the connector elements being connected to the power source circuit and being fixed in position relative to the housing, and wherein the housing comprises a plurality of separable housing elements, and the pair of connector elements is arranged and constructed to automatically connect at the same time that the housing elements are joined to form the housing.

4. An apparatus as in claim 3, further comprising a light base disposed within the housing, wherein the light is coupled to the light base.

5. An apparatus as in claim 4, wherein the light base is formed integrally with the retaining means and the retaining means is disposed along the inner surface of the housing.

6. An apparatus as in claim 5, wherein the retaining means comprises a wire guide having at least one clamp for retaining the electric line.

7. An apparatus as in claim 4, wherein the light base is formed separately from the retaining means, and wherein the retaining means is disposed along the outer surface of the housing.

8. An apparatus as in claim 7, wherein the retaining means further includes a first connector and a second connector, the first connector detachably and electrically connecting the electric line to the power source circuit, and the second connector detachably and electrically connecting the electric line and the light.

9. An apparatus as in claim 8, wherein the first connector comprises a pair of first connector elements that are electrically and mechanically connected to each other, one of the first connector elements being connected to the electric line and being fixed in position relative to the retaining means, and the other of the first connector elements being connected to the power source circuit and being fixed in position relative to the housing.

10. An apparatus as in claim 9, wherein the second connector comprises a pair of second connector elements that are electrically and mechanically connected to each other, one of the second connector elements being connected to the electric line and being fixed in position relative to the retaining means, and the other of the second connector elements being connected to the light and being fixed in position relative to the light base.

11. An apparatus as in claim 3, wherein the retaining means comprises a wire-receiving recess defined within the housing and a wire guide fitted within the wire-receiving recess.

12. An apparatus as in claim 11, wherein the wire receiving recess is defined within the outer surface of the housing.

13. An apparatus as in claim 3, wherein the retaining means comprises a wire-receiving recess defined within the housing, the electric line being disposed within the wire-receiving recess, and a cover enclosing the electric line within the wire-receiving recess.

14. An apparatus as in claim 13, wherein the wire receiving recess is defined within the outer surface of the housing.

15. A power tool comprising:

a housing having a housing wall, an electric motor disposed within the housing, a power source circuit disposed within the housing, the power source circuit being arranged and constructed to connect to a source of current, a light connected to the power source circuit via an electric line, the light being mounted on or within the housing in a manner that will illuminate a tool bit or an area of a workpiece that will be machined by the power tool, a wire guide retaining at least a portion of the electric line, the wire guide extending along and proximal to an inner surface of the housing wall; and a light base coupled to the light and the wire guide;

the wire guide having a first end fixed to the light base and a second end configured as a free end, the second end opposing to the light and having a connector element for electrically connecting the wire to the power source circuit.

16. A power tool comprising:

a housing having a housing wall, an electric motor disposed within the housing, a power source circuit disposed within the housing, the power source circuit being arranged and constructed to connect to a source of current, a light connected to the power source circuit via an electric line, the light being mounted on or within the housing in a manner that will illuminate a tool bit or an area of a workpiece that will be machined by the power tool, a wire guide retaining at least a portion of the electric line, the wire guide extending along and proximal to an outer surface of the housing wall; and a light base coupled to the light and the wire guide;

the wire guide having a joint portion, the joint portion extending from the outside to the inside of the housing wall and joined to the light base, and the electric line being connected to the light via the joint portion.

17. A power tool as in claim 16, wherein the electric line extends through the joint portion and is detachably and electrically connected to the light.

* * * * *